United States Patent [19]

Knudslien

[11] Patent Number: 4,844,424

[45] Date of Patent: Jul. 4, 1989

[54] FENCE STRUCTURE

[76] Inventor: Don Knudslien, Box 33 - Enwistle, Alberta, Canada, T0E 0S0

[21] Appl. No.: 135,642

[22] Filed: Dec. 21, 1987

[51] Int. Cl.[4] ..... E04H 17/16

[52] U.S. Cl. ..... 256/26; 256/24; 256/73

[58] Field of Search ..... 256/26, 24, 73

[56] References Cited

U.S. PATENT DOCUMENTS

| | | | |
|---|---|---|---|
| 3,204,606 | 9/1965 | Parr et al. | 256/26 X |
| 3,767,167 | 10/1973 | Rasmussen | 256/26 |
| 4,371,148 | 2/1983 | Harden | 256/73 X |

*Primary Examiner*—Andrew V. Kundrat

*Attorney, Agent, or Firm*—Harold H. Dutton, Jr.

[57] ABSTRACT

Simple, portable fence units for constructing fences are not new. It is also known to interconnect adjacent fence sections using pins and sockets. An improved version of a fence structure for constructing straight or angled fence sections in corrals or animal feeders includes a section or unit for connection to other similar sections or units including a rectangular frame with couplings on each end thereof. The coupling on one end is a pair of short, parallel tubes or sleeves which are welded together and welded to the end of the frame. The other coupling includes a pair of spaced apart tubes or sleeves for receiving the first coupling therebetween. When the outermost sleeves of the couplings on opposite ends of two adjacent frames are axially aligned and a pin is inserted therethrough, the two frames can be pivoted with respect to each other or define an angled length of fence. When both of the sleeves of one coupling are axially aligned with both pairs of sleeves of the other coupling, and a pin or pins is inserted through both pairs of axially aligned sleeves, the two adjacent units are fixedly interconnected to form a straight length of fence.

11 Claims, 8 Drawing Sheets

FENCE STRUCTURE

BACKGROUND OF THE INVENTION

This invention relates to a fence structure, and in particular to a fence structure for constructing corrals or animal feeders.

Fence structures including a plurality of portable sections are by no means new. Examples of such structures are found in U.S. Pat. Nos. 3,767,167, which issued to H. C. Rasmussen on Oct. 23, 1973; 3,910,560, which issued to H. E. Goetz on Oct. 7, 1975 and 4,371,148, which issued to R. L. Harden on Feb. 1, 1983. While such fence structures possess varying degrees of utility, they are either unnecessarily cumbersome, or do not lend themselves to the construction of animal feeders with a plurality of tight corners. A need exists for a fence system which can be used to form straight or angled sections of fence quickly.

The object of the present invention is to meet the above defined need by providing a relatively simple fence structure, which includes readily portable and easily assembled sections.

BRIEF SUMMARY OF THE INVENTION

Accordingly, the present invention relates to a fence structure comprising a section for connection to other similar sections to define a length of fence, said section including frame means; and coupling means for interconnecting adjacent sections, said coupling means including a first pair of adjacent, parallel sleeve means on one side of said frame means; a second pair of adjacent parallel sleeve means on a side of said frame means opposite to said one side, said first and second pair of sleeve means lying in different horizontal planes, whereby, when the outermost of first and second sleeve means of a pair of adjacent frame means are axially aligned and pin means is inserted therethrough, the two frame means are pivotally interconnected for forming a gate or angled length of fence, and, when both first sleeve means of one frame means are axially aligned with both second sleeve means of an adjacent frame means, and pin means is inserted through both pairs of axially aligned sleeve means, the two frame means are fixedly interconnected to form a straight length of fence.

BRIEF DESCRIPTION OF THE DRAWINGS

The invention will be described in detail with reference to the accompanying drawings, which illustrate preferred embodiments of the invention, and wherein.

DESCRIPTION OF THE PREFERRED EMBODIMENT

Figure 1:
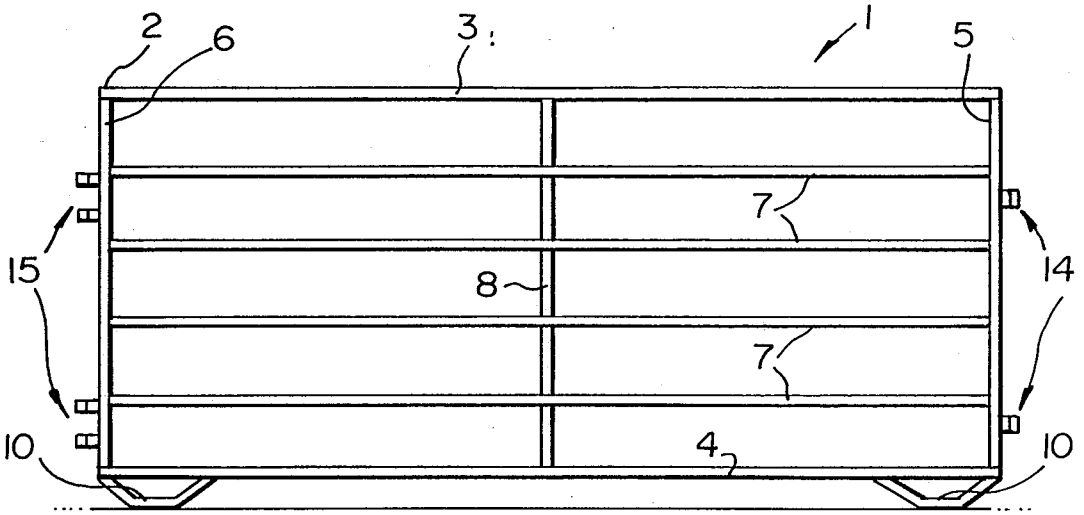
FIG. 1 is a side elevation view of a fence section or unit in accordance with the present invention.

With reference to FIG. 1, the basic unit of the fence structure of the present invention is a section generally indicated at 1. The sections 1 includes a rectangular frame 2 defined by a top bar 3, a bottom bar 4, ends 5 and 6, and crossbars 7. A post 8 extends between the centre of the top and bottom bars 3 and 4, respectively, and is connected to the cross bars 6 for reinforcing the structure. a pair of generally U-shaped feet 10 with upwardly flaring arms are provided on each bottom corner of the frame 2.

Figure 2:
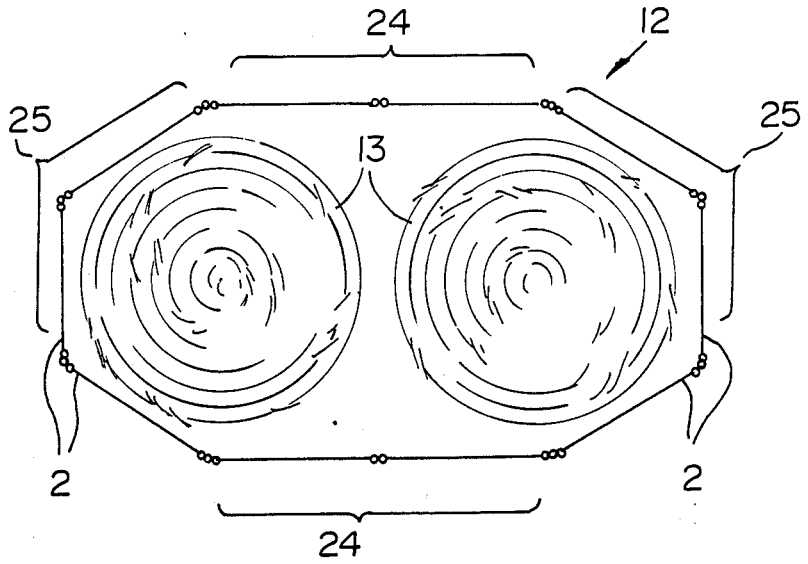
FIG. 2 is a schematic plan view of an animal feeder formed of fence sections in accordance with the present invention.
Figure 3:
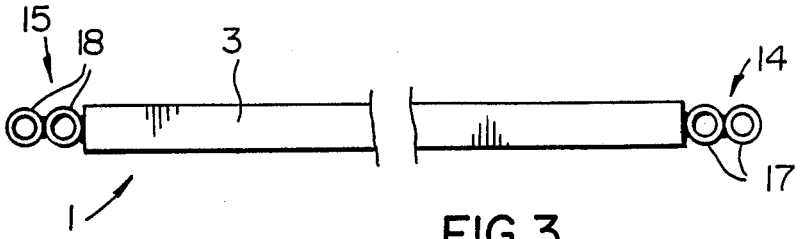
FIG. 3 is a plan view of the ends of the fence section of FIG. 1.
Figure 5:
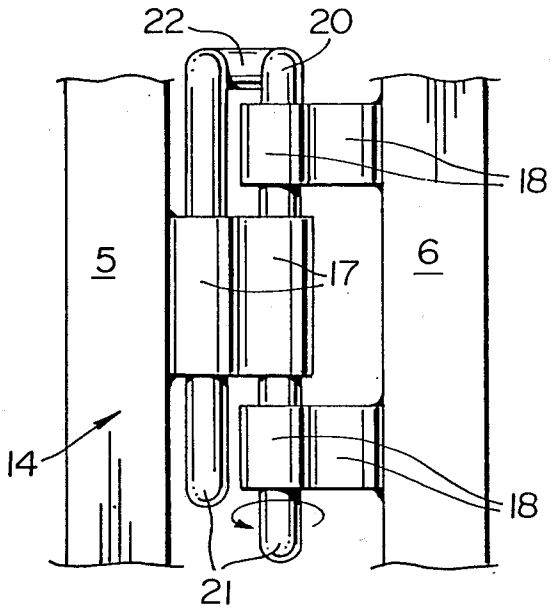
FIGS. 4 and 5 are side elevation views of couplings used to connect fence sections of the type shown in FIGS. 1 to 3.
Figure 4:
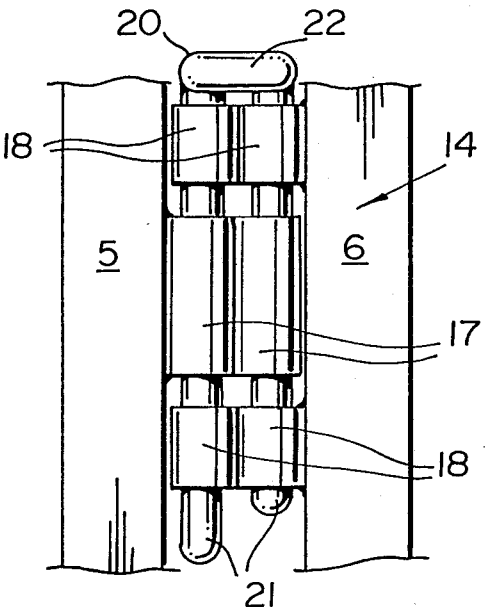

A plurality of sections 1 can be interconnected to form a fence (not shown) or corral 12 (FIG. 2). The corral 12 in FIG. 2 is a fence surrounding round bales 13, i.e. forms an animal feeder. A pair of couplings generally indicated at 14 and 15 is provided on the ends 5 and 6, respectively of each fence section 1. Referring to FIGS. 3 to 5, each coupling 14 is defined by a pair of parallel, interconnected sleeves 17, which are mounted on the outer surface of one end 5 of the frame 2 and each coupling 15 is defined by two pairs of parallel, interconnected sleeves 18, which are mounted on the outer surface of the other end 6 of the frame 2. The sleeves 17 are interconnected and mounted on the ends 5 and 6 of the frame 2 by welding. The spacing between the pairs of sleeves 18 is somewhat greater than the length of the sleeves 17, so that the latter can be positioned between and aligned with the former.

Figure 8:
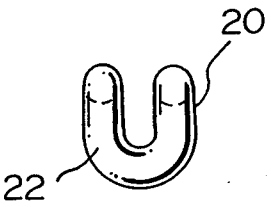
FIG. 8 is a plan view of the pin of FIGS. 6 and 7.
Figure 7:
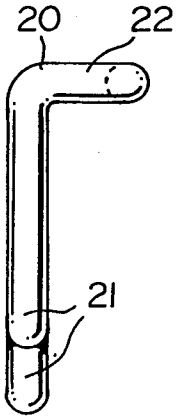
FIG. 7 is a side elevation view of the pin of Fig. 6.
Figure 6:
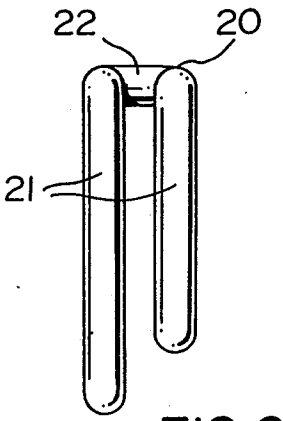
FIG. 6 is an end view of a pin used in the couplings of FIGS. 4 and 5.
Figure 10:
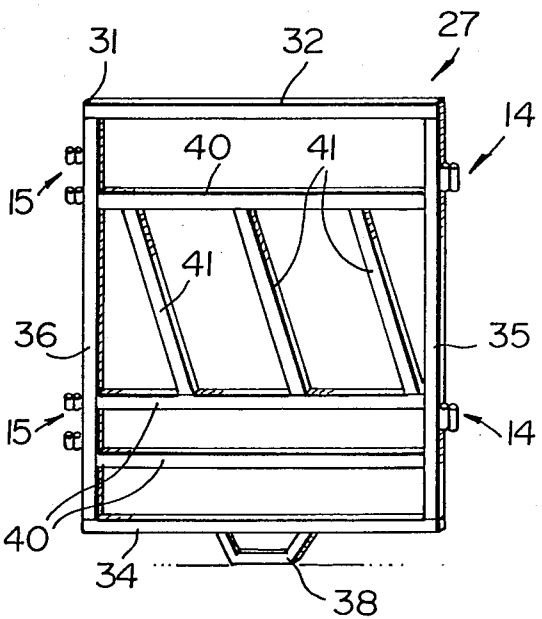
FIGS. 9 to 16 are perspective views of fence sections in accordance with the present invention used to construct animal feeders.
Figure 9:
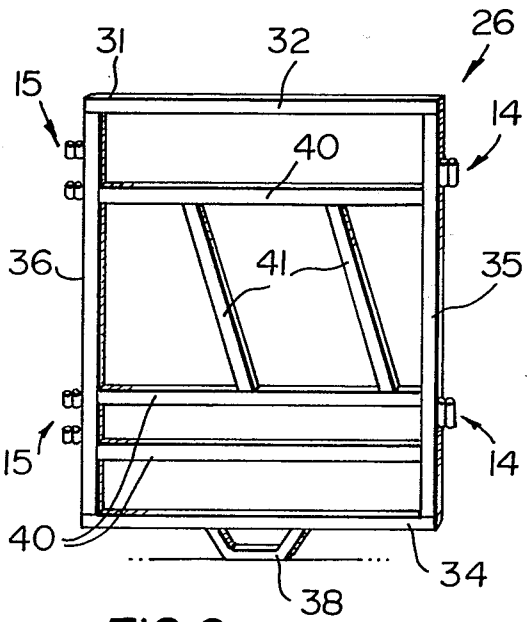
Figure 12:
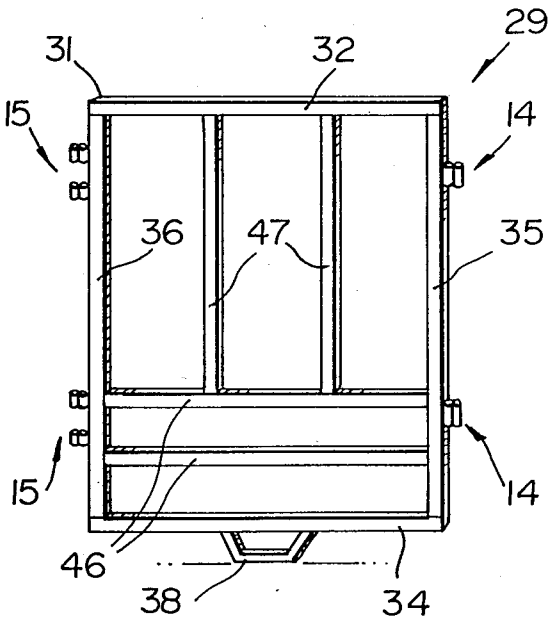
Figure 11:
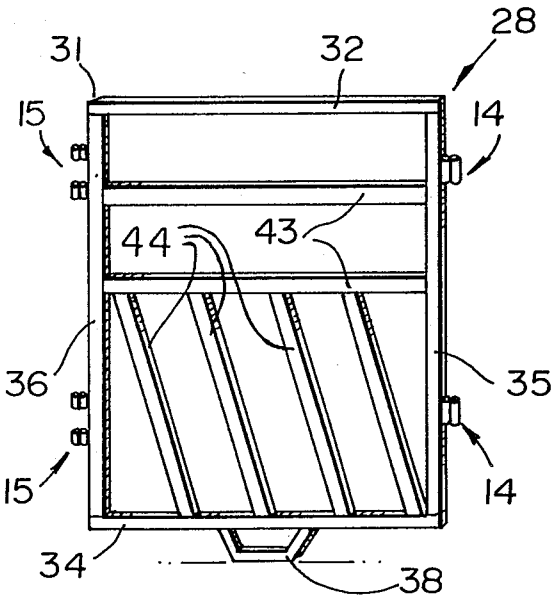

As best shown in FIGS. 4 and 5, each set of sleeves 17 and 18 is interconnected by a generally inverted, U-shaped rod 20 (FIGS. 6 to 8), including a pair of parallel arms 21 interconnected at one end by a C-shaped top 22 integral with the arms 21. When both of the sleeves 17 of one coupling 14 are axially aligned with both sleeves 18 of a coupling 15, i.e. the outermost sleeve 17 of a coupling 14 is aligned with the innermost sleeves 18 of a coupling 15 and vice versa (FIG. 4) and the arms 21 are inserted through the sleeves, the two adjacent sections 1 carrying the couplings 14 and 15 are firmly interconnected to form a rectilinear length 24 of fence (FIG. 2). When the outermost sleeves 17 and 18 of couplings 14 and 15 are axially aligned (FIG. 5), and one arm 21 of the pin 20 is inserted into the aligned sleeves, the two adjacent sections 1 of fence are free to rotate for forming a gate or angled lengths 25 of fence (FIG. 2).

Referring to FIGS. 9 to 12, fence sections generally indicated at 26, 27, 28 and 29 can be used to form the sides of feeders for a variety of animals, in this case a cow feeder, a calf feeder, a sheep feeder and a horse feeder.

Each feeder section 26, 27, 28 and 29 includes a rectangular frame 31 defined by a top bar 32, a bottom bar 34, ends 35 and 36, a foot 38, and couplings 14 and 15 on the ends 36 and 36, respectively.

In the cow and calf feeder fence sections 26 and 27 (FIGS. 9 and 10), crossbars 40 and inclined bars 41 are used to define entry preventing top and bottom sections, and middle, inclined or vertical slots permitting access to the feed by the animal. The only difference between the cow and calf feeder sections 26 and 27 are the number and spacing of the inclined bars 41.

The sheep feeder fence sections 28 (FIG. 11) include upper crossbars 43 and inclined bottom bars 44 defining slots, permitting access to the feed by the animal.

The horse feeder fence sections 29 (FIG. 12) include lower crossbars 46 extending between the sides 35 and 36, and vertical top bars 47, which define slots with the sides 35 and 36 of the section.

Figure 14:
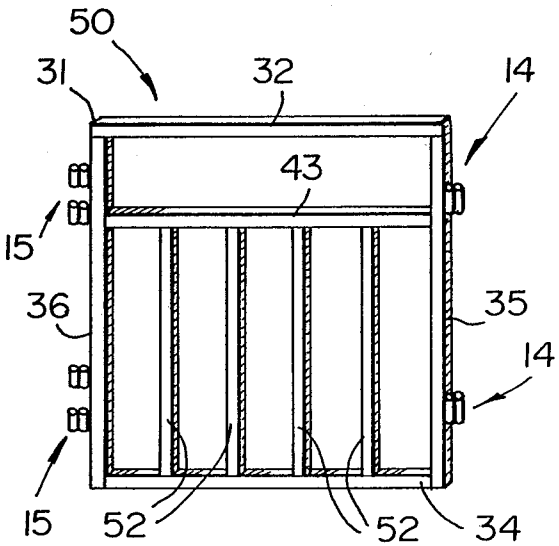
Figure 13:
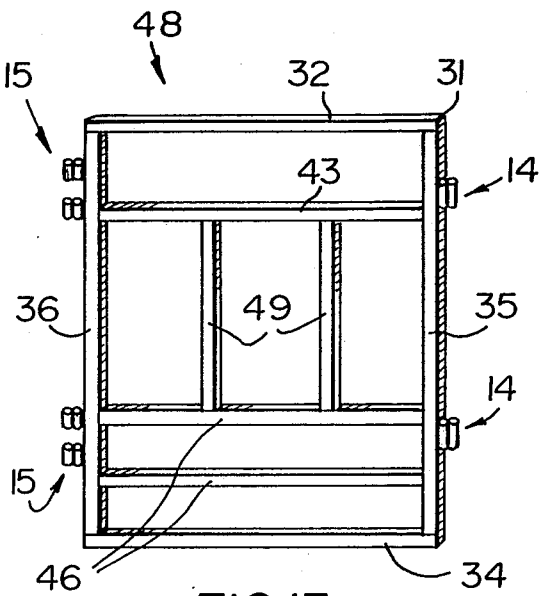
Figure 15:
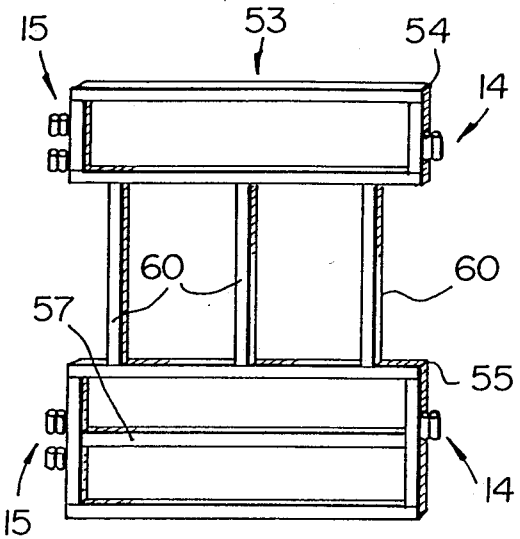

Referring to FIGS. 13 to 15, no feet are required on the fence sectiosn of animal feeders. Moreover, the bars extending between the crossbars can be vertical. In the yearling feeder 48 of FIG. 13, the bottom bar 34 rests on the ground during use. A top crossbar 43 is provided, and vertical bars 49 extend between the top and next crossbar 46 to define head receiving openings.

By the same token, a sheep feeder 50 (FIG. 14) includes a rectangular frame 31 for resting on the ground during use, a single top crossbar 43, and vertical bars 52 extending between the crossbar 43 and the bottom bar 34 to define head receiving openings.

The cow feeder 53 of FIG. 15 includes upper and lower rectangular frames 54 and 55, each carrying couplings 14 and 15. A crossbar 57 extends between the sides 58 of the lower frame 55 for reinforcing the latter. The frames 54 and 55 are interconnected by vertical bars or posts 60.

Figure 16:
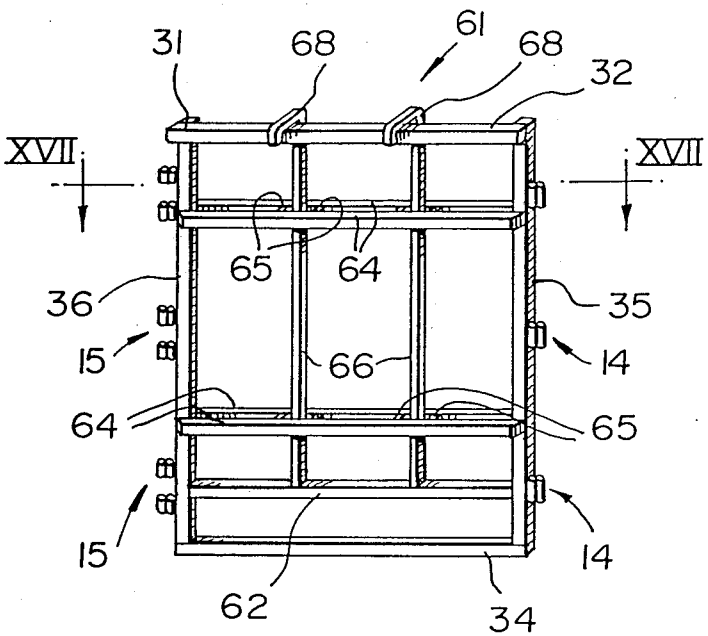
Figure 17:
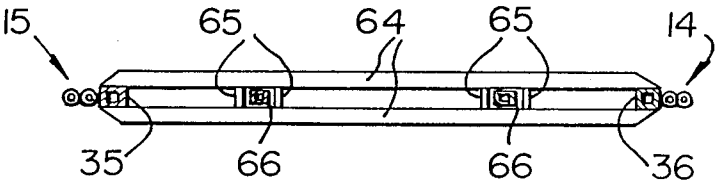
FIG. 17 is a cross section taken generally along line XVII—XVII of FIG. 16.

FIGS. 16 and 17 illustrate a reinforced bull feeder fence section 61. The fence section 61 includes a rectangular frame 31 defined by a top bar 32, bottom bar 34, and sides 35 and 36 extending therebetween. Three couplings 14 are provided on one side 35, and three couplings 15 are provided on the other side 36 of the frame 31. A single bottom cross bar 62 extends between the sides 35 and 36. Two additional pairs of crossbars 64 extend between the sides 35 and 36. As best shown in FIG. 17, two pairs of plates 65 extending between the crossbars 64 define sockets for slidably receiving vertical bars 66. Hooks 68 are provided on the top ends of the bars 66 for limiting downward movement thereof. In the use position, the bottom ends of the bars 66 rest on the crossbar 62. One or more bars 66 can be removed, depending on the length of the horns on the bulls.

It will be readily apparent that steel tubes of square cross section are used to construct each embodiment of the invention. The elements of the frames are welded together, and the tubes used to form the couplings 14 and 15 are also welded to each other and to the frame sides.

Thus, there has been described a relatively simple fence structure defined of readily portable units or sections, which can be used to construct fences, corrals surrounding large areas or animal feeders.

What is claimed is:

1. A fence structure comprising a section for connection to other similar sections to define a length of fence, said section including frame means; and coupling means for interconnecting adjacent sections, said coupling means including a first pair of adjacent, parallel sleeve means on one side of said frame means; a second pair of adjacent parallel sleeve means on a side of said frame means opposite to said one side, said first and second pair of sleeve means lying in different horizontal planes, whereby, when the outermost of first and second sleeve means of a pair of adjacent frame means are axially aligned and pin means is inserted therethrough, the two frame means are pivotally interconnected for forming a gate or angled length of fence, and, when both first sleeve means of one frame means are axially aligned with both second sleeve means of an adjacent frame means, and pin means is inserted through both pairs of axially aligned sleeve means, the two frame means are fixedly interconnected to form a straight length of fence, said first sleeve means including a first pair of parallel interconnected sleeves on one side of each frame means; and said second sleeve means including two pairs of second parallel sleeves on an opposite side of each said frame means, said second pairs of sleeves being spaced apart by a distance greater than the length of said pair of sleeves for receiving the latter therebetween, whereby adjacent similar sections can be pivotally or fixedly interconnected, and said pin means comprising a substantially inverted U-shaped rod, the arms of which can be inserted simultaneously into said first and second sleeve means for interconnecting adjacent fence sections.

2. A fence structure according to claim 1, wherein said pin means includes handle means perpendicular to the top ends of said arms of the rod.

3. A fence structure according to claim 2, wherein said handle means is substantially C-shaped and integral with the top ends of said arms.

4. A fence structure according to claim 1, including foot means on said frame means for supporting the latter above the ground.

5. A fence structure according to claim 4, wherein said foot means is substantially U-shaped, including outwardly and upwardly flaring arms.

6. A fence structure according to claim 1, wherein said frame means incudes straight sides and ends defining a rectangular border; crossbar means extending between said sides and vertical bar means extending between selected of said crossbar means to define slots for receiving animal heads.

7. A fence structure according to claim 1, wherein said frame means includes straight sides and ends defining a rectangular border; crossbar means extending between said sides and inclined bar means extending between selected of said crossbar means to define slots for receiving animal heads.

8. A fence structure according to claim 1, wherein said frame means includes straight sides and ends defining a rectangular border; crossbar means extending between said sides near the top end of said frame means, and vertical bar means extending between said crossbar means and the bottom end of said frame means to define slots for receiving animal heads.

9. A fence structure according to claim 6, wherein said vertical bar means incudes vertical bars slidably mounted in selected of said crossbars, permitting removal thereof for widening the head receiving slots.

10. A fence structure according to claim 9, including hook means on the top ends of said vertical bars for engaging the top end of said frame means for retaining said vertical bars in position.

11. A fence structure according to claim 1, wherein said frame means includes straight sides and ends defining top and bottom rectangular borders carrying said sleeve means; and vertical bar means extending between said top and bottom borders defining slots for receiving animal heads.

* * * * *